US008740822B2

(12) United States Patent
Hiki et al.

(10) Patent No.: US 8,740,822 B2
(45) Date of Patent: Jun. 3, 2014

(54) WALKING ASSIST DEVICE

(75) Inventors: Yutaka Hiki, Wako (JP); Zenta Sugawara, Wako (JP); Jun Ashihara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 916 days.

(21) Appl. No.: 12/935,725

(22) PCT Filed: Feb. 6, 2009

(86) PCT No.: PCT/JP2009/000461
§ 371 (c)(1),
(2), (4) Date: Sep. 30, 2010

(87) PCT Pub. No.: WO2009/122641
PCT Pub. Date: Oct. 8, 2009

(65) Prior Publication Data

US 2011/0028874 A1 Feb. 3, 2011

(30) Foreign Application Priority Data

Apr. 1, 2008 (JP) ..... 2008-095244

(51) Int. Cl.
*A61H 3/00* (2006.01)

(52) U.S. Cl.
USPC ..... 601/35; 601/5; 601/33; 602/16; 602/23

(58) Field of Classification Search
CPC ..... A61H 1/00; A61H 1/0237; A61H 1/0262; A61H 3/00; A61H 2001/002; A61H 2001/0237; A61H 2003/00; A61H 2201/1215; A61H 2201/1418; A61H 2201/1436; A61H 2201/1633; A61H 2201/1642; A61H 2201/165; A61H 2201/1676; A61H 2201/1628; A61H 2201/163; A61H 2203/0406; A61H 2205/10; A61H 2205/106; A61H 2205/108; A61H 2205/12
USPC ..... 601/5, 23, 33, 34, 35; 602/5, 16, 19, 23, 602/26, 27
See application file for complete search history.

(56) References Cited

U.S. PATENT DOCUMENTS

| | | | | |
|---|---|---|---|---|
| 5,476,441 | A * | 12/1995 | Durfee et al. | 602/23 |
| 5,658,242 | A * | 8/1997 | McKay et al. | 602/16 |
| 6,666,796 | B1 * | 12/2003 | MacCready, Jr. | 482/51 |

FOREIGN PATENT DOCUMENTS

| | | |
|---|---|---|
| JP | 62-045419 | 3/1987 |
| JP | 06-114089 | 4/1994 |
| JP | 09-210048 | 8/1997 |
| JP | 3074203 | 10/2000 |
| JP | 2007-020909 | 2/2007 |
| JP | 2007-315920 | 12/2007 |
| JP | 2008-012224 | 1/2008 |

* cited by examiner

*Primary Examiner* — Quang D Thanh
(74) *Attorney, Agent, or Firm* — Rankin, Hill & Clark LLP

(57) ABSTRACT

An actuator is reduced in weight without impairing a walking assist function, and this reduces the inertial moment of a leg link. A drive crank arm on the output shaft of the actuator and a driven crank arm fixed to a second link portion so as to be concentric to the joint shaft of a third joint portion are connected to each other via a connection link. The connection link is placed so that a line connecting a pivot portion at which the drive crank arm is pivotally mounted and a pivot portion at which the driven crank arm is pivotally mounted obliquely crosses a line connecting the output shaft of the actuator and the joint shaft of the third joint portion.

3 Claims, 4 Drawing Sheets

WALKING ASSIST DEVICE

PRIORITY CLAIM

The present application is based on and claims the priority benefit of Japanese Patent Application 2008-095244 filed on Apr. 1, 2008, the contents of which are incorporated herein by reference in its entirety.

BACKGROUND OF THE INVENTION

1. Field of the Invention

The present invention relates to a walking assist device for assisting a user in walking.

2. Description of the Related Art

Conventionally, as a walking assist device, there has been known one provided with a load transmit portion, a foot mounting portion mounted to a user's foot, and a leg link disposed between the load transmit portion and the foot mounting portion (for example, refer to Patent Document 1: Japanese Patent Laid-Open No. 2007-20909). The walking assist device is configured to transmit a force generated from the leg link to the user's trunk via the load transmit portion.

The leg link in the walking assist device includes an upper first link portion connected to the load transmit portion via a first joint portion, a lower second link portion connected to the foot mounting portion via a second joint portion, a middle third joint portion connected to the first link portion and the second link portion in such a way that the first link portion and the second link portion can stretch and bend freely, and a drive mechanism to drive the third joint portion.

Thereby, the load applied to a leg of the user can be alleviated according to the force generated by the drive mechanism in the direction of decreasing a flexion angle of the third joint portion (same as the direction of stretching the leg link).

In the device disclosed in Patent Document 1, the load transmit portion is composed of a seat member on which the user sits astride, and the first joint portion is composed of an arc-shaped guide rail which is connected to the seat member and is longitudinal in an anteroposterior direction with the center of curvature located above the seat member and a slider which is fixed at an upper end portion of the first link portion and is movably engaged in the guide rail.

Thereby, the center of curvature of the guide rail is equivalent to the swing fulcrum for the leg link of the first joint portion in the anteroposterior direction. Since the swing fulcrum is located above the seat member, the seat member can be prevented from inclining greatly in the vertical direction due to the shifting in the weight of the user.

Further, in the device disclosed in Patent Document 1, the slider is engaged to a part of the guide rail which is positioned at a rear side to the connection line connecting the center of curvature of the guide rail and the joint shaft of the third joint portion. Thereby, the swing stroke of the leg link to the forward so as to follow the forward movement of a free leg (the leg with foot leaving away from the floor) of the user can be assured without increasing the length of the guide rail to the forward direction too much; consequently, it is expected to reduce the size of the first joint portion.

The drive mechanism described in an embodiment of the Patent Document 1 is provided with a rotary actuator mounted to the first link portion, and a wire-typed force transmit portion configured to transmit a force from the rotary actuator to the third joint portion via a wire. However, the drive mechanism is not limited thereto, specifically, it is acceptable that the drive mechanism is provided with the rotary actuator mounted to the first link portion, a drive crank arm disposed on an output shaft of the rotary actuator, a driven crank arm fixed to at the second link portion concentrically to a joint shaft of the third joint portion, and a connection link with one end pivoted at the drive crank arm and the other end pivoted at the driven crank arm.

Generally, it has been considered to configure the drive mechanism as a parallel link mechanism by disposing the connection link in such a way that a connection line connecting a pivot portion of the connection link at which the drive crank arm is pivotally mounted and a pivot portion of the connection link at which the driven crank arm is pivotally mounted is parallel to a connection line connecting the output shaft of the rotary actuator and the joint shaft of the third joint portion.

However, if the inertial moment of the leg link around the first joint portion is greater, when the user swings the free leg to the forward, the load applied to the free leg due to the inertial moment of the leg link will become greater. Therefore, it is desired to reduce the inertial moment of the leg link. In this regarding, if the rotary actuator mounted at the first link portion is made lighter, the inertial moment of the leg link can be reduced. However, in order to generate the desired assist force for the leg link, it is necessary for the rotary actuator to output a torque of at least a certain magnitude; therefore, there is a limit on reducing the weight of the rotary actuator.

To solve this problem, it has been considered to increase the length of the driven crank arm longer than the length of the drive crank arm to decrease the rotational angular velocity of the driven crank arm slower than the rotational angular velocity of the drive crank arm so as to increase the torque transmitted to the driven crank arm, in other words, to increase the drive torque of the third joint portion greater than the output torque of the rotary actuator. However, this solution brings about the following problem, that is, for the leg link with the first link portion and the second link portion connected by the third joint portion in such a way that the first link portion and the second link portion can stretch and bend freely, the telescopic velocity of the leg link obtained by differentiating the length of the leg link (the length of a line segment connecting the first joint portion at the upper end and the second joint portion at the lower end) by the flexion angle of the third joint portion slows down as the flexion angle of the third joint portion decreases. Therefore, in order to improve the controllability in a small range of the flexion angles of the third joint portion, it is necessary to make the flexion angle vary faster. Accordingly, in the device where the rotational angular velocity of the driven crank arm is slower than the rotational angular velocity of the drive crank arm, the required rotational velocity of the rotary actuator would be greater, which makes it difficult to reduce the weight of the rotary actuator.

SUMMARY OF THE INVENTION

The present invention has been accomplished in view of the aforementioned problems, and it is therefore an object of the present invention to provide a walking assist device capable of alleviating the inertial moment of a leg link through reducing the weight of a rotary actuator without impairing a walking assist function thereof.

To attain an object described above, a walking assist device according to the present invention is provided with a load transmit portion, a foot mounting portion mounted to a user's foot, and a leg link disposed between the load transmit portion and the loot mounting portion, the walking assist device being configured to transmit a force generated from the leg link to the user's trunk via the load transmit portion, and the leg link including an upper first link portion connected to the load transmit portion via a first joint portion, a lower second link portion connected to the foot mounting portion via a second joint portion, a middle third joint portion connected to the first link portion and the second link portion in such a way that the first link portion and the second link portion can stretch and bend freely, and a drive mechanism to drive the third joint portion, wherein the drive mechanism is provided with a rotary actuator mounted to the first link portion, a drive crank arm disposed on an output shaft of the rotary actuator, a driven crank arm fixed to at the second link portion concentrically to a joint shaft of the third joint portion, and a connection link with one end pivoted at the drive crank arm and the other end pivoted at the driven crank arm, and the connection link is disposed in such a way that a connection line connecting a pivot portion of the connection link at which the drive crank arm is pivotally mounted and a pivot portion of the connection link at which the driven crank arm is pivotally mounted obliquely crosses a connection line connecting the output shaft of the rotary actuator and the joint shaft of the third joint portion.

According to the present invention, since the connection line connecting the pivot portion of the connection link at which the drive crank arm is pivotally mounted and the pivot portion of the connection link at which the driven crank arm is pivotally mounted obliquely crosses the connection line connecting the output shaft of the rotary actuator and the joint shaft of the third joint portion, the ratio between the rotational angular velocity of the driven crank arm and the rotational angular velocity of the drive crank arm varies according to the rotation angle of the drive crank arm. Further, in a flexion angle range of the third joint portion when the user is in normal walking (walking on a flat floor), the rotational angular velocity of the driven crank arm is made slower than the rotational angular velocity of the drive crank arm so as to obtain a torque amplifying effect to make the toque (the drive torque of the third joint portion) transmitted to the driven crank arm greater than the output torque from the rotary actuator. According thereto, it is possible to increase the rotational angular velocity of the driven crank arm greater than the rotational angular velocity of the drive crank arm in a small range of the flexion angles of the third joint portion. Thereby, it is possible to increase only a small amount of amplified torque in the output torque of the rotary actuator needed to generate the assist force required in the normal walking. Thus, the required rotational angular velocity of the rotary actuator can be inhibited lower with only an increment on velocity so as to assure the controllability in a small range of the flexion angles of the third joint portion. Consequently, the weight of the rotary actuator can be reduced without impairing the walking assist function. Thereby, the inertial moment of the leg link around the first joint portion is reduced, and the load applied to the free leg when the user swings the free leg to the forward can be alleviated.

In the present invention, similar to Patent Document 1, the load transmit portion is composed of a seat member on which the user sits astride, the first joint portion is composed of an arc-shaped guide rail which is connected to the seat member and is longitudinal in an anteroposterior direction with the center of curvature located above the seat member, and a slider which is fixed at the upper portion of the first link portion and is movably engaged in the guide rail, the slider is engaged to a part of the guide rail which is positioned at a front side or a rear side to the connection line connecting the center of curvature of the guide rail and the joint shaft of the third joint portion, and it is desirable that the pivot portion of the connection link at which the drive crank arm is pivotally mounted is disposed opposite to the guide rail with respect to the connection line connecting the output shaft of the rotary actuator and the joint shaft of the third joint portion. According thereto, without providing a motion space for the drive crank arm and the connection link between the output shaft of the rotary actuator and the guide rail, the rotation shaft of the rotary actuator, namely, the center of gravity of the rotary actuator can be positioned nearby the guide rail. Moreover, a supporting force for supporting the weight of the user, namely, the force in the direction of decreasing the flexion angle of the third joint portion can be transmitted through the tension of the connection link. Different from transmitting the force through pushing, it is not necessary to enlarge the cross sectional area of the connection link to prevent it from buckling, which makes it possible to reduce the self weight of the connection link. Consequently, the inertial moment of the leg link around the first joint portion (around the center of curvature of the guide rail) can be further alleviated.

Moreover, it is necessary to provide an accessory member such as a battery in the first link portion. In this situation, as mentioned above, the pivot portion of the connection link at which the drive crank arm is pivotally mounted is disposed opposite to the guide rail with respect to the connection line connecting the output shaft of the rotary actuator and the joint shaft of the third joint portion. Accordingly, the accessory member can be disposed at a position at a portion of the first link portion where closer to the guide rail than to the connection line connecting the output shaft of the rotary actuator and the joint shaft of the third joint portion without interfering with the connection link. Thereby, the distance between the accessory member and the guide rail becomes shorter, and resultantly, the inertial moment of the leg link around the first joint portion can be prevented from increasing due to the weight of the accessory member as much as possible.

DETAILED DESCRIPTION OF THE PREFERRED EMBODIMENTS

Figure 1:
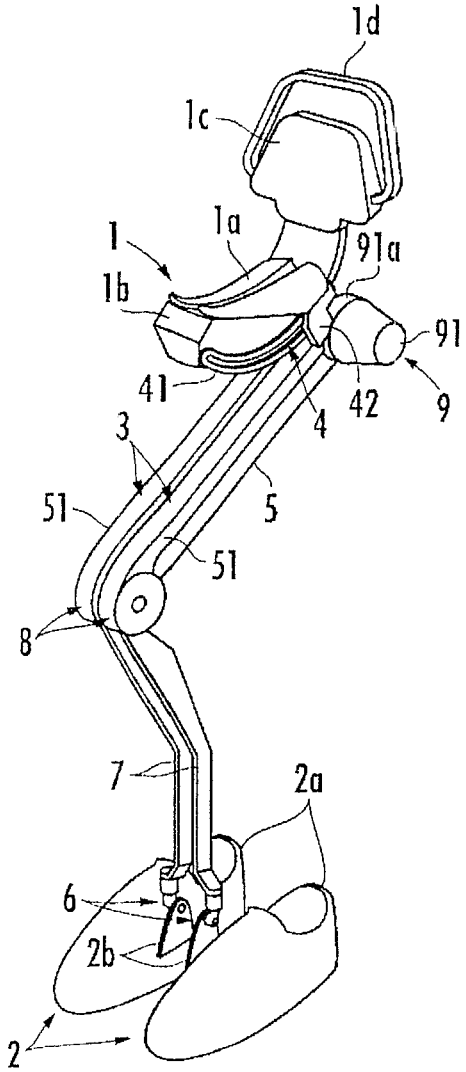
FIG. 1 is a perspective view of a walking assist device according to an embodiment of the present invention.

A walking assist device according to an embodiment of the present invention will be described hereinafter. As illustrated from FIG. 1 to FIG. 3, the walking assist device includes a seat member 1 as a load transmit portion on which a user P sits astride, a pair of left and right foot mounting portions 2 and 2 which are attached to user's left and right feet, respectively, and a pair of left and right leg links 3 and 3 disposed between the seat member 1 and the pair of left and right foot mounting portions 2 and 2.

Each leg link 3 is composed of an upper first link portion 5 connected to the seat member 1 via a first joint portion 4, a lower second link portion 7 connected to the foot mounting portion 2 via a second joint portion 6, a middle third joint portion 8 connected to the first link portion 5 and the second link portion 7 in such a way that the first link portion 5 and the second link portion 7 can stretch and bend freely, and a drive mechanism 9 to drive the third joint portion 8. Then, a force in the direction of stretching each leg link 3 is applied to each leg link 3 from the third joint portion 8 driven by the drive mechanism 9 to generate a supporting force which supports at least a part of the user's weight (hereinafter, referred to as assist force). The assist force generated in each leg link 3 is transmitted to the trunk of the user P via the seat member 1 to alleviate the load on the leg of the user P.

The seat member 1 is composed of a seat portion 1*a* where the user P sits, a support frame 1*b*, and a waist supporter 1*c*. The seat portion 1*a* is of a saddle shape. The support frame 1*b* is disposed below the seat portion 1*a* to support the seat portion 1*a*. The support frame 1*b* is configured to extend upward behind the seat portion 1*a*. The support frame 1*b* has an uprising portion at a rear end thereof. The waist supporter 1*c* is fixed at the uprising portion. The waist supporter 1*c* is provided with a holding portion 1*d* of an arch shape to be held by the user P if necessary.

The first joint portion 4 for each leg link 3 has an arc-shaped guide rail 41 connected to the seat member 1. Then, each leg link 3 is movably engaged with the guide rail 41 via a plurality of rollers 43 pivotally attached to a slider 42 which is fixed to the upper end of the first link portion 5. Thereby, each leg link 3 swings in the anteroposterior direction around the center of curvature 4*a* of the guide rail 41 and the anteroposterior swing fulcrum of each leg link 3 with respect to the first joint portion 4 functions as the center of curvature 4*a* of the guide rail 41.

Furthermore, the guide rail 41 is pivotally supported at the uprising portion formed at the rear end of the support frame 1*b* of the seat member 1 via a spindle 4*b* which is longitudinal in the anteroposterior direction. Thus, the guide rail 41 is connected to the seat member 1, capable of swinging freely in the lateral direction. According thereto, each leg link 3 is allowed to swing in the lateral direction, which enables the user P to abduct the legs thereof. In addition, the anteroposterior swing fulcrum of each leg link 3 (the center of curvature 4*a* of the guide rail 41) and the lateral swing fulcrum (the spindle) 4*b* are both located above the seat portion 1*a*. Thereby, the seat member 1 can be prevented from inclining greatly both in the vertical direction and the lateral direction when the user P shifts the body weight thereof.

The first link portion 5 is disposed to be inclined backward. The slider 42 is engaged to a part of the guide rail 41 which is positioned at a rear side to the connection line connecting the center of curvature 4*a* of the guide rail 41 and a joint shaft 8*a* of the third joint portion 8. Thereby, the swing stroke of the leg link 3 to the forward so as to follow the forward movement of a free leg of the user P can be assured without increasing the length of the guide rail to the forward direction too much.

Figure 2:
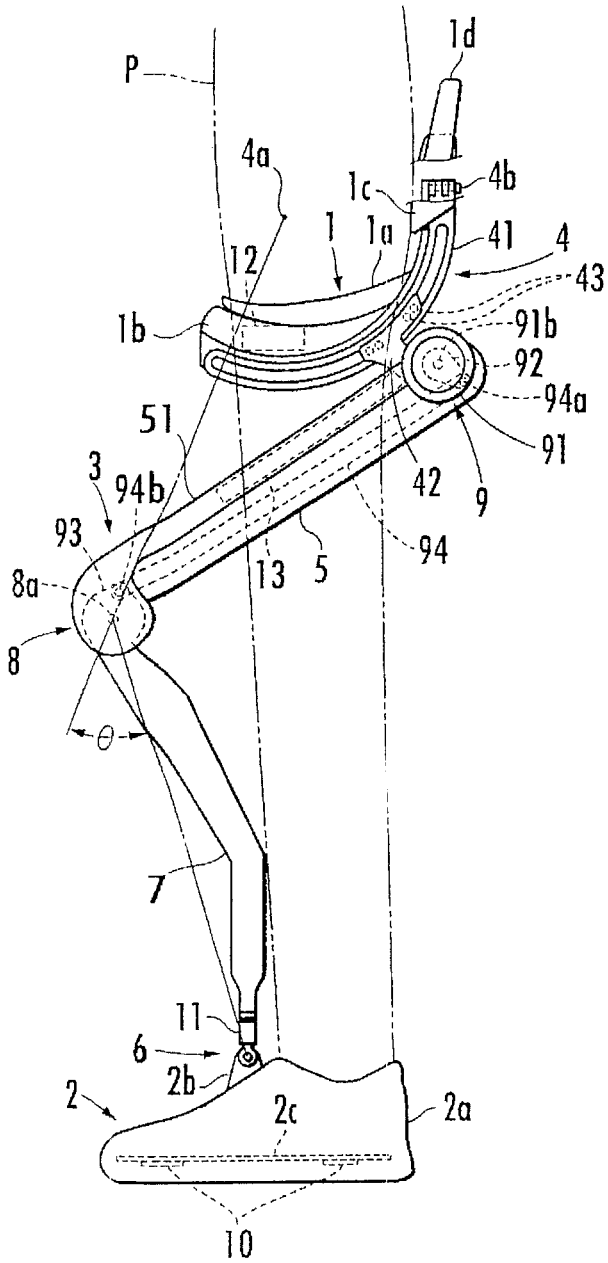
FIG. 2 is a side view of the walking assist device according to the embodiment.
Figure 3:
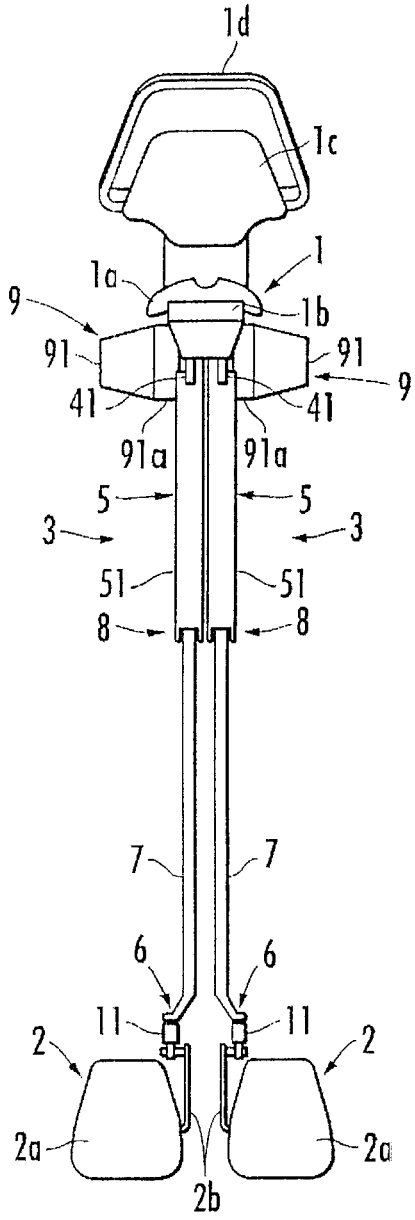
FIG. 3 is a front view of the walking assist device according to the embodiment.

Each foot mounting portion 2 has a shoe 2*a* and a joint member 2*b* protruding upward from the inside of the shoe 2*a*. The second link portion 7 of each leg link 3 is connected to the joint member 2*b* via the second joint portion 6 of a three-axis structure. As illustrated in FIG. 2, a pair of longitudinally disposed pressure sensors 10 and 10, which detect loads applied to the metatarsophalangeal joint (MP joint) and the heel of each foot of the user P, respectively, are attached to the undersurface of an insole 2*c* provided in the shoe 2*a*. Moreover, a 2-axis force sensor 11 is built into the second joint portion 6. Detection signals from the pressure sensors 10 and the force sensor 11 are input into a controller 12 housed in the support frame 1*b* of the seat member 1. On the basis of the detection signals from the pressure sensors 10 and the force sensor 11, the controller 12 performs a walking assist control by controlling the driving source 9 to drive the third joint portion 8 of the leg link 3 to generate the above-mentioned assist force.

The assist force is applied on a connection line (hereinafter, referred to as a reference line) joining a swing fulcrum 4*a* of the leg link 3 with respect to the first joint portion 4 in the anteroposterior direction and a swing fulcrum of the leg link 3 with respect to the second joint portion 6 in the anteroposterior direction. In the walking assist control, the actual assist force applied on the reference line (accurately, a resultant force between the assist force and a force generated by the weights of the seat member 1 and each leg link 3) is calculated based on detection values of forces in the two-axis direction detected by the force sensor 11. Thereafter, on the basis of the stepping force detected by the pressure sensors 10 for each foot mounting portion 2, a ratio of the stepping force of each foot with respect to the resultant force applied to both feet of the user P is calculated. Then, a desired control value of the assist force which should be generated in each leg link 3 is calculated by multiplying a predefined value of the assist force by the calculated ratio of the stepping force of each foot. Subsequently, the driving mechanism 9 is controlled so as to make the actual assist force calculated on the basis of the detection values by the force sensor 11 approximate to the desired control value.

Figure 4:
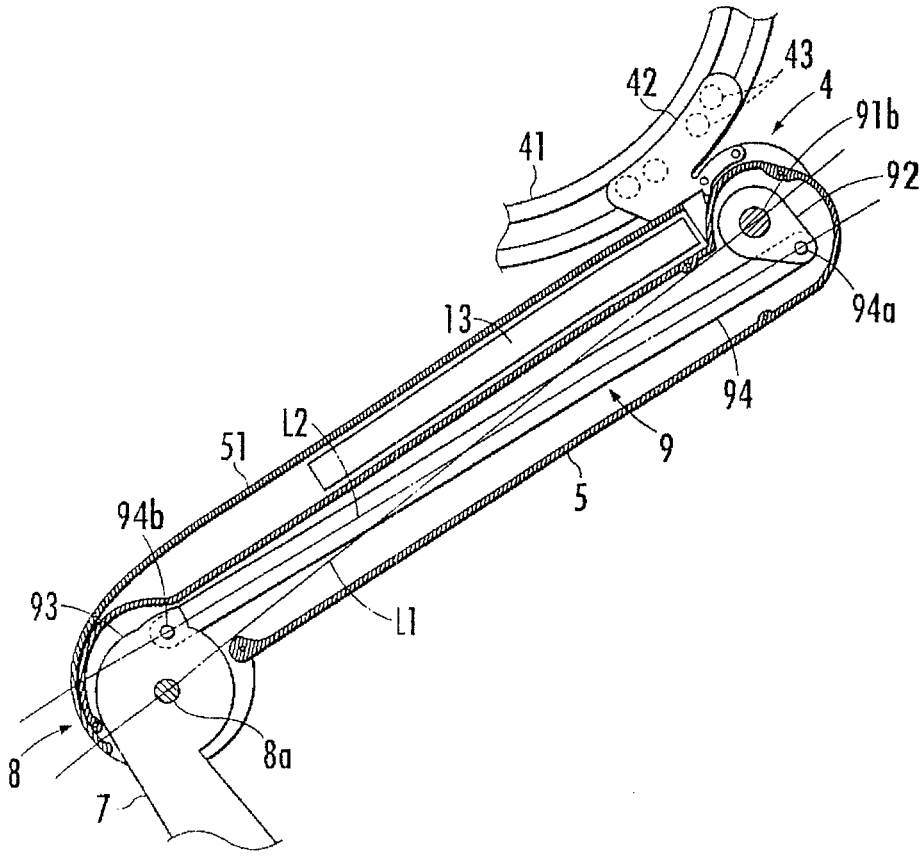
FIG. 4 is a partial cutaway side view of a first link portion of the walking assist device according to the embodiment.

The drive mechanism 9 is provided with a rotary actuator 91 mounted on the outer surface of the upper end portion of the first link portion 5, a drive crank arm 92 disposed on an output shaft 91*b* of the rotary actuator 91, a driven crank arm 93 fixed to at the second link portion 7 concentrically to the joint shaft 8*a* of the third joint portion 8, and a connection link 94 with one end thereof pivoted at the drive crank arm 92 and the other end pivoted at the driven crank arm 93. The rotary actuator 91 is composed of an electric motor provided with a reduction gear 91*a*. As illustrated in FIG. 4, the connection link 94 is disposed in such a way that a connection line L2 connecting a pivot portion 94*a* of the connection link 94 at which the drive crank arm 92 is pivotally mounted and a pivot portion 94*b* of the connection link 94 at which the driven crank arm 93 is pivotally mounted (hereinafter, referred to as a floating link line) obliquely crosses a connection line L1 connecting the output shaft 91*b* of the rotary actuator 91 and the joint shaft 8*a* of the third joint portion 8 (hereinafter, referred to as a fixed link line).

When the floating link line L2 is obliquely crossed with the fixed link line L1, a ratio between the rotational angular velocity of the driven crank arm 93 and the rotational angular velocity of the drive crank arm 92 varies according to the rotation angle of the drive crank arm 92. In the present embodiment, when the flexion angle θ of the third joint portion 8 (the angle formed between the line passing through the third joint portion 8 and the center of curvature 4*a* of the guide rail 41 and the line passing through the third joint portion 8 and the second joint portion 6) is in the range of about 20° to 70°, the ratio of the angular velocity between the driven crank arm 93 and the drive crank arm 92 (the rotational angular velocity of the driven crank arm 93/the rotational angular velocity of the drive crank arm 92) is equal to or less then 1. When the ratio of the angular velocity is equal to or less then 1, the torque transmitted to the driven crank arm 93, namely the drive torque of the third joint portion 8 becomes equal to or greater than the output torque of the rotary actuator 91.

When the user P is in normal walking (walking on a flat floor), the flexion angle θ of the third joint portion 8 ranges from about 40° to 70°. Thus, in the range of the flexion angles of the third joint portion 8 when the user P is in normal walking, the rotational angular velocity of the driven crank arm 93 is slower than the rotational angular velocity of the drive crank arm 92. As a result thereof, in normal walking, a torque amplifying effect is obtained to make the drive torque of the third joint portion 8 greater than the output torque of the rotary actuator 91; consequently, the output torque of the rotary actuator 91 needed to generate the desired assist force is limited to the amount of the amplified torque only.

The telescopic velocity of the leg link 3 obtained by differentiating the length of the line segment between the swing fulcrum 4*a* of the leg link 3 with respect to the first joint portion 4 and the second joint portion 6 (the length of the leg link) by the flexion angle θ of the third joint portion 8 slows down as the flexion angle θ decreases. In order to improve the controllability in a small range of the flexion angles θ, it is necessary to make the flexion angle θ vary faster. Accordingly, the required rotation velocity of the rotary actuator 91 would be greater, which makes it difficult to reduce the weight of the rotary actuator 91. To solve this problem, in the present embodiment, the rotational angular velocity of the driven crank arm 93 is made faster than the rotational angular velocity of the drive crank arm 92 to gain the velocity increasing effect in the range of flexion angles θ equal to or less than about 20°. Thereby, the required rotational angular velocity of the rotary actuator 91 can be inhibited lower with only the increment on velocity so as to assure the controllability in a small range of the flexion angles θ.

Accordingly, in the present embodiment, according to the torque amplifying effect in normal walking and the velocity increasing effect in a small range of flexion angles θ, the weight of the rotary actuator 91 can be reduced without impairing a walking assist function thereof. Thereby, the inertial moment of the leg link 3 around the first joint portion 4 is reduced, and the load applied to the free leg when the user P swings the tree leg thereof to the forward can be alleviated.

In the present invention, the pivot portion 94*a* of the connection link 94 at which the drive crank arm 92 is pivotally mounted is disposed opposite to the guide rail 41 of the first joint portion 4 with respect to the fixed link line L1. According thereto, without providing a motion space for housing the drive crank arm 92 and the connection link 94 between the output shall 91*b* of the rotary actuator 91 and the guide rail 41, the rotation shall 91*b* of the rotary actuator 91, namely, the center of gravity of the rotary actuator 91 can be positioned close to the guide rail 41.

Moreover, the assist force supporting the weight of the user P, namely, the force in the direction of decreasing the flexion angle θ of the third joint portion 8 can be transmitted from the rotary actuator 91 to the third joint portion 8 through the tension of the connection link 94. Different from transmitting the force through pushing, it is not necessary to enlarge the cross sectional area of the connection link 94 to prevent it from buckling, which makes it possible to reduce the self weight of the connection link 94. Consequently, in addition to disposing the center of gravity of the rotary actuator 91 close 10 the guide rail 41, the inertial moment of the leg link 3 around the first joint portion 4 (around the center of curvature 4*a* of the guide rail 41) can be further alleviated.

Moreover, as mentioned above, the pivot portion 94*a* of the connection link 94 at which the drive crank arm 92 is pivotally mounted is disposed opposite to the guide rail 41 of the first joint portion 4 with respect to the fixed link line L1. Accordingly, a space can be assured in a portion of the first link portion 5 closer to the guide rail 41 than to the fixed link line L1 without interfering with the connection link 94. In the present embodiment, the accessory member 13 such as the battery or the like is disposed in the space. Thereby, the distance between the accessory member 13 and the guide rail 41 becomes shorter, and resultantly, the inertial moment of the leg link 3 around the first joint portion 4 can be prevented from increasing due to the weight of the accessory member 13 as much as possible. In addition, a cover 51 covering the accessory member 13 is attached to the first link portion 5.

Though the embodiment of the present invention has been described as above, it is not limited thereto. For example, in the above-mentioned embodiment, the slider 42 is engaged to a part of the guide rail 41 which is positioned at a rear side than the connection line connecting the center of curvature 4*a* of the guide rail 41 and the joint shaft 8*a* of the third joint portion 8. However, by bending the leg link 3 opposite to the one described in the above-mentioned embodiment in the lateral direction, it is acceptable to engage the slider 42 to a part of the guide rail 41 which is position at a front side than the connection line connecting the center of curvature 4*a* of the guide rail 41 and the joint shaft 8*a* of the third joint portion 8. In this case, by disposing the pivot portion of the connection link 94 at which the drive crank arm 92 is pivotally mounted opposite to the guide rail 41 with respect to the connection line connecting the output shaft 91*b* of the rotary actuator 91 and the joint shaft 8*a* of the third joint portion 8, similar effect can be obtained as in the above-mentioned embodiment.

In the embodiment mentioned above, the first joint portion 4 is configured to have the guide rail 41 of an arc shape and the swing fulcrum 4*a* of each leg link 3 in the anteroposterior direction with respect to the first joint portion 4 is located above the seat member 1. However, it is also possible to configure the first joint portion 4 to a simple-structured joint portion having a spindle in the lateral direction to pivotally support each leg link 3 so that the upper end portion thereof can freely swing in the anteroposterior direction. It is also acceptable to adopt a spring mounted around the waist of the user as the load transmit portion. Moreover, in order to assist the walking of a handicapped user whose one leg is crippled due to bone fracture or the like, it is possible to leave only one leg link of the left and right leg links 3 and 3 in the above-mentioned embodiment corresponded to the crippled leg of the user by removing the other.

What is claimed is:

1. A walking assist device which is provided with a load transmit portion, a foot mounting portion adapted to be mounted to a user's foot, and a leg link disposed between the load transmit portion and the foot mounting portion, the walking assist device being configured to transmit a force generated from the leg link to the user's trunk via the load transmit portion, and the leg link including an upper first link portion connected to the load transmit portion via a first joint portion, a lower second link portion connected to the foot mounting portion via a second joint portion, a middle third joint portion connected to the first link portion and the second link portion in such a way that the first link portion and the second link portion can stretch and bend freely, and a drive mechanism to drive the third joint portion, wherein the drive mechanism is provided with a rotary actuator mounted to the first link portion, a drive crank arm disposed on an output shaft of the rotary actuator, a driven crank arm fixed to at the second link portion concentrically to a joint shaft of the third joint portion, and a connection link with one end pivoted at the drive crank arm and the other end pivoted at the driven crank arm, and the connection link is disposed in such a way that a connection line connecting a pivot portion of the connection link at which the drive crank arm is pivotally mounted and a pivot portion of the connection link at which the driven crank arm is pivotally mounted obliquely crosses a connection line connecting the output shaft of the rotary actuator and the joint shaft of the third joint portion.

2. The walking assist device according to claim 1, wherein the load transmit portion is composed of a seat member adapted for the user to sit astride, the first joint portion is composed of an arc-shaped guide rail which is connected to the seat member and is longitudinal in an anteroposterior direction with a center of curvature located above the seat member and a slider which is fixed at an upper portion of the first link portion and is movably engaged in the guide rail, the slider is engaged to a part of the guide rail which is positioned at a front side or a rear side to a connection line connecting the center of curvature of the guide rail and the joint shaft of the third joint portion, and the pivot portion of the connection link at which the drive crank arm is pivotally mounted is disposed opposite to the guide rail with respect to the connection line connecting the output shaft of the rotary actuator and the joint shaft of the third joint portion.

3. The walking assist device according to claim 2, wherein the first link portion is provided with an accessory member at a position closer to the guide rail than to the connection line connecting the output shaft of the rotary actuator and the joint shaft of the third joint portion.

* * * * *